United States Patent [19]

Hesterberg

[11] Patent Number: 4,888,213

[45] Date of Patent: Dec. 19, 1989

[54] METHOD AND APPARATUS FOR DRYING COATINGS ON ARTICLES

[75] Inventor: William G. Hesterberg, Rosendale, Wis.

[73] Assignee: Brunswick Corporation, Skokie, Ill.

[21] Appl. No.: 183,664

[22] Filed: Apr. 19, 1988

[51] Int. Cl.[4] ..... B44D 1/20; B05D 3/12; B05D 7/22; B05C 13/06

[52] U.S. Cl. ..... 427/133; 34/103; 34/105; 118/32; 118/35; 422/231; 422/232; 422/240; 422/346; 427/372.2

[58] Field of Search ..... 427/133, 240, 372.2, 427/231, 232, 346; 34/103, 105; 118/53, 52

[56] References Cited

U.S. PATENT DOCUMENTS

Re. 29,590 3/1978 Whelan ..... 34/105

1,327,273 1/1920 Eskilson ..... 118/52

3,755,915 9/1973 Nagell ..... 34/105

*Primary Examiner*—Janyce Bell

*Attorney, Agent, or Firm*—Andrus, Sceales, Starke & Sawall

[57] ABSTRACT

A method and apparatus for accelerating drying of coatings on contoured articles and particularly articles having internal recesses or passages. The coated article is suspended by a hanger from a conveyor or other support and a rotatable drive mechanism is operably associated with the hanger and acts to spin the coated article about a vertical axis, while the article is exposed to an elevated temperature, to accelerate drying of the coating. The spinning substantially increases the drying rate, particularly in internal passages of the article, and provides a more uniform dried coating.

16 Claims, 1 Drawing Sheet

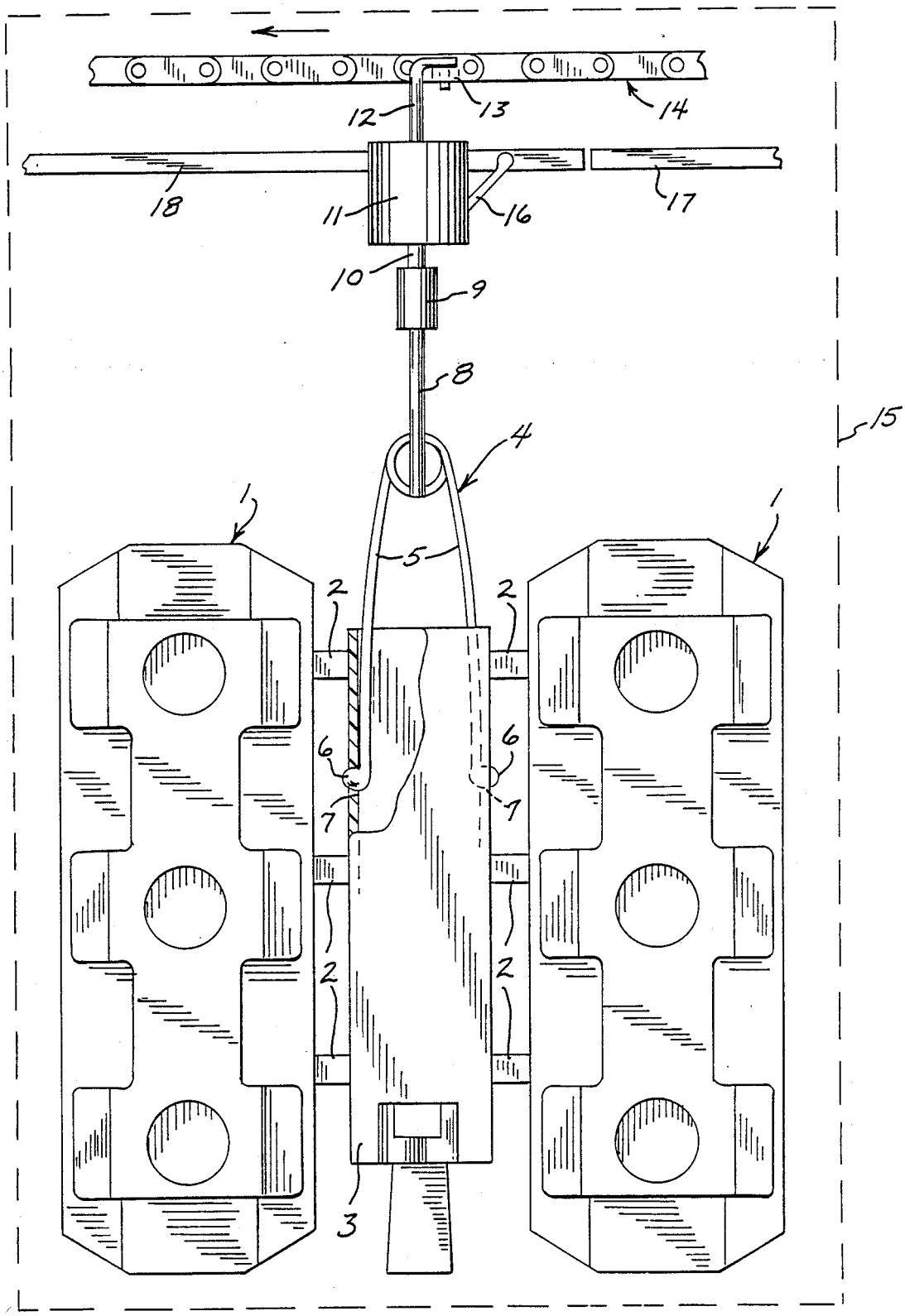
12
13
14
18
11
16
17
10
9
8
15
4
1
1
5
2
2
6
6
7
7
2
2
3

METHOD AND APPARATUS FOR DRYING COATINGS ON ARTICLES

BACKGROUND OF THE INVENTION

In evaporable foam casting methods, a pattern formed of an evaporable foam material, such as polystyrene, is positioned within an outer mold and a flowable material, such as sand, is introduced into the mold to surround the pattern and fill the internal passages in the pattern. When a molten metal is introduced into the mold, the molten metal will vaporize the foam pattern, with the vapor passing into the interstices of the sand, while the molten metal fills the void produced by the evaporation of the pattern. The resulting cast metal article has a shape identical to the foam pattern.

In normal practice, the pattern, as well as the sprue and the gating connecting the sprue to the pattern, is coated with a refractory material which normally consists of a suspension or slurry of aluminum silicate in water and containing a binder, such as clay. The coating, after drying on the pattern, governs the fill rate by controlling the flow of vapor into the sand during the casting operation.

In conventional processes, the coating is applied to the pattern by dipping, brushing, or flow coating, and the wet coated patterns are suspended by hangers from racks or from a conveyor. The racks or conveyors are then passed through a gas fired or electrically heated oven to dry the coating material. The oven must be maintained at a temperature sufficiently low to prevent any adverse effect on the foam pattern material, the coating, and any adhesives that may be present.

The conventional drying method allows for wide variations in solvent removal rates. Internal passages and recesses are isolated from air currents and tend to saturate the air in the passages, thus retarding evaporation of the solvent or carrier. This effect is particularly significant in water based slurry coatings. Because most pattern systems must be maintained at temperatures below 160° C., it has been found that external surfaces of the pattern may dry at approximately three times the rate of drying of internal isolated passages.

In an attempt to equalize the drying rate on external and internal surfaces it has been proposed to utilize convection fans in association with ovens to direct air to internal passages in the patterns. However, the specialized fixturing which is necessary to utilize convection fans is not feasible from an economic or operational standpoint.

It has also been proposed to dry water based coatings through the use of microwave energy and to concentrate the energy on those areas of the pattern, such as internal passages, which are difficult to dry. However, the use of microwave energy has not proven satisfactory, in that is is difficult to control the energy transmission to avoid overheating and thus damaging the pattern or other item being dried. Secondly, the use of microwave energy does not address the situation that the internal passages may be saturated with the solvent or carrier, with no method of removing the saturated vapor. A further concern is the cost and safety issues associated with utilizing microwaves in an industrial environment.

SUMMARY OF THE INVENTION

The invention is directed to a method and apparatus for drying coatings on contoured articles, and particularly articles having internal passages or recesses. The invention has particular application to evaporable foam patterns, although it can also be employed to dry coatings on other expendable patterns, such as investment casting patterns, or other articles.

In accordance with the invention, the article is coated with a slurry consisting of a refractory material and an evaporable carrier, such as water. The coated article is suspended by a hanger from a conveyor, or other support and can be passed through an oven. While exposed to the elevated temperature in the oven, the hanger is rotated to correspondingly rotate the coated article about a vertical axis.

By spinning or rotating the coated article, faster drying is promoted, particularly in internal passages or recesses that are not normally accessible to ambient air.

The invention also includes a provision for varying the rate of rotation of the coated article during the drying cycle, with the variation of rotational speed depending on the nature and contour of the article, and the composition of the coating.

The invention also promoted enhanced drying control. The rotational velocity can be programmed to accomplish uniform drying throughout the surface area of the article. For example, the drying rate differential between external surfaces and isolated internal surfaces can be reduced by increasing the spin rate, while preservation of coating uniformity can be promoted by reducing the spin rate. Thus, adjusting the spin rate throughout the drying cycle allows control of both characteristics.

The reduction in drying differential between internal and external surfaces is particularly significant in situations where multiple coatings are applied, as in investment casting shell formation. Defects in the shell can occur if subsequent coats are applied too soon, in which case sloughing can occur, or if the subsequent coating is applied too late, cracking of the coating can occur.

The invention also promotes temperature uniformity, in that cooling is associated with solvent evaporation and reduction in drying differential rates promotes reduction of temperature variations associated with drying. Again, this feature is of particular significance when the pattern is susceptible to thermally driven size changes, such as wax patterns used in the investment casting process, or in the case of an extremely brittle coating which may fracture upon differential cooling.

By reducing the drying time, substantial capital investment costs can be realized by reducing the size and space requirements for the drying ovens and correspondingly reducing the space requirements of the enclosure or building for the ovens.

As an additional benefit to the process of the invention, the more rapid drying permits earlier inspection of the finished product, which, in turn, allows process modification, if necessary, to promote quality improvement or to avoid scrappage.

The invention also promotes flexibility in that a variety of configurations can be presented in succession for drying treatment and it is not necessary to modify the apparatus or process when utilizing articles of different contour or complexity.

Other objects and advantages will appear in the course of the following description.

DESCRIPTION OF THE DRAWINGS

The drawing illustrates the best mode presently contemplated of carrying out the invention.

In the drawings:

The drawing is a schematic representation of the apparatus for carrying out the invention.

DESCRIPTION OF THE ILLUSTRATED EMBODIMENT

The drawing shows in schematic form an apparatus for drying a coating on evaporable foam patterns 1, as used in an evaporable foam casting process. As illustrated, a pair of patterns 1 are connected by gating 2 to a central hollow sprue 3.

The patterns 1, which are formed of an evaporable foam material, such as polystyrene, generally have a complexly contoured shape containing numerous internal passages or recesses. As an example, the patterns 1 may constitute components for an internal combustion engine, such as the cylinder block, or the like. Gating 2 as well as sprue 3 are also formed of evaporable foam material.

The coating, which is applied to the outer surfaces of the pattern 1, gating 2 and sprue 3, is a conventional type, being a water based slurry of a refractory material, such as aluminum silicate, and a binder, such as clay. The slurry is applied to the outer surfaces of pattern 1 by any conventional means, such as dipping, flow coating, brushing, or the like.

In the drying operation, sprue 3 is suspended from a hanger 4. As shown in the drawing, the hanger 4 includes a pair of legs 5, which terminate in feet 6 that are received within holes 7 in the opposed walls of the sprue. Hanger 4 is constructed so that legs 5 are spring biased outwardly to thereby maintain feet 6 in engagement with the holes 7.

Hanger 4 also includes a vertical shaft 8, which is connected by a coupling 9 to the drive shaft 10 of an electric motor 11. A hook 12 is secured to the upper end of motor 11, and is engaged within an opening in a bracket 13 attached to a conveyor 14. As illustrated, conveyor 14 is a chain type conveyor, but it is contemplated that various types of conveyors, or other supports, can be employed to suspend the motor 11 and hanger 4.

Conveyor 14 acts to move the suspended patterns 1 through an oven, indicated by 15. The oven is a conventional type, heated either electrically or gas fired, which will heat the coated patterns to an elevated temperature, generally in the range of about 145° F. to 160° F. The particular construction of the oven in itself forms no part of the invention. The temperature employed in oven 15 must, of course, be such that it will not adversely effect or cause deterioration of the foam patterns 1, gating 2 or sprue 3, or the coating thereon, or any adhesive which is used to join the pattern sections or join the gating to the sprue and patterns.

While the drawings illustrate the use of a conveyor 14 to convey the patterns 1 through the oven 15, it is contemplated that a batch system may also be employed where the hook 12 is suspended from a rack and the rack is positioned in the oven 15 for the drying operation.

While the patterns 1 are exposed to the elevated temperature in oven 15, the motor 11 is operated to thereby rotate the hanger 4 and correspondingly rotate the patterns 1 about the axis of shaft 8.

During the drying cycle, it may be desirable to vary the speed of rotation of the patterns, depending upon the contour of the pattern, the internal passages therein and the nature of the coating. In this regard, a contact arm 16, which is connected to the windings of the motor 11, is biased into engagement with one of a series of bus bars 17 and 18, which are mounted beneath the conveyor 14. A direct current is applied to each bus bar 17,18 and in the construction shown, the magnitude of the current can be different in the two bus bars 17,18. Thus, as the patterns 1 and motor 11 are moved through the oven 15, by the conveyor 14, the contact will ride from bus bar 17 to bus bar 18 thereby varying the current applied to the motor and correspondingly changing the speed of rotation of the patterns. By increasing the speed of rotation at a period during the drying cycle, the differential drying rate between external surfaces and isolated internal surfaces can be reduced. The air movement caused by rotation replaces solvent saturated air in internal passages with fresh air.

Through the rotation of the patterns, a substantial increase in the rate of drying is achieved, particularly in patterns having comparatively inaccessible passages or recesses. In drying the coating on an evaporable foam pattern for a cylinder block of a two-cycle engine, it has been found that the coating was dried 20% faster when the pattern was spun at 119 rpm, as compared to the same pattern dried without rotation. In both situations the patterns were dried in a convection oven at 145° F.

By increasing the drying rate, a substantial reduction in capital requirements can be attained, particularly in high volume production, due to the reduction in oven floor space. The expedited drying also serves to reduce in-process inventory, thus resulting in associated savings.

The hangers 4 and associated motor 11 can be employed to support patterns of any desired configuration without any change or alteration of the system. This promotes flexibility of the drying operation.

While the above description has shown in the invention as used for drying coatings on evaporable foam patterns, it is contemplated that the invention can be employed to dry coatings on other expendable patterns or other articles. For example, the invention has application for investment casting procedures, in which the investment casting shell is produced on a wax pattern through multiple coating operations. By providing a more uniform dried coating in a shorter period of time, the production rate of investment casting shells can be substantially increased.

Various modes of carring out the invention are contrmplated as being within the scope of the following claims particularly pointing out and distincyly claiming the subject matter which is regarded as the invention.

I claim:

1. An apparatus for drying a coating on an article, comprising hanger means for suspending a contoured article containing an internal recess, said article having an external surface and an internal surface bordering said recess and having a coating on said surfaces, said coating including an evaporable carrier, means for heating the coated article to an elevated temperature, and rotatable drive means operably connected to said hanger means for rotating said hanger means and said coated article about a vertical axis while said coated article is exposed to said elevated temperature, said drive means being constructed and arranged to rotate said article at a speed sufficient to circulate air within said recess to evaporate said carrier and dry the coating on said surfaces.

2. The apparatus of claim 1, and including conveyor means, said hanger means being supported from said conveyor means.

3. The apparatus of claim 1, wherein said drive means comprises a motor directly connected to said hanger means.

4. The apparatus of claim 1, and including means for varying the speed of rotation of said hanger means.

5. The apparatus of claim 4, wherein said drive means comprises a motor operably connected to said hanger means, and said means for varying the speed of rotation of said hanger means comprises a plurality of bus bars disposed in longitudinally spaced relation and said motor includes contact means operably connected to the motor and selectively engageable with said bus bars, the magnitude of current being applied to a first of said bus bars being different from that applied to the second of said bus bars, so that sequential engagement of said contact means with said bus bars will vary the current applied to said motor and correspondingly vary the speed of rotation of said hanger means.

6. The apparatus of claim 1, wherein said article comprises a plurality of evaporable foam patterns and sprue means connected to said patterns.

7. The apparatus of claim 6, where said sprue means has a hollow interior bordered by a wall, said wall having a pair of legs, said legs being spring biased into engagement with said holes.

8. The apparatus of claim 1, wherein said drive means comprises a motor operably connected to said hanger means.

9. The apparatus of claim 1, wherein said hanger means is engaged with an internal surface of said article.

10. The method of drying a coating on an article, comprising the step of forming a contoured article having at least one internal recess, coating the outer surface of the article and the internal surface bordering said recess with a slurry composed of a coating material and an evaporable carrier, exposing said article to an elevated temperature, rotating said article about a vertical axis while exposed to said elevated temperature to thereby evaporate said carrier and provide a dry coating on the outer and internal surfaces of said article.

11. The method of claim 10, and including the step of varying the speed of rotation of said article.

12. The method of claim 10, and including the step of heating the coated article to an elevated temperature while rotating said article.

13. The method of claim 10, wherein said step of forming an article comprises forming a pattern from an evaporable foam material.

14. The method of claim 10, wherein said step of forming a pattern comprises forming a pattern from wax.

15. A method of drying a coating on an article, comprising the steps of forming a contoured article having an external surface and an internal surface bordering an internal recess, coating the external surface and the internal surface with a slurry composed of a coating material and an evaporable carrier, subjecting the coated article to a drying cycle by rotating said article about an axis at a first speed while exposed to air to circulate air over the external surface and within said internal recess, and thereafter varying the speed of rotation of said article to a second speed different from said first speed to thereby dry said coating on said external and internal surfaces.

16. The method of claim 15, wherein the step of varying the speed comprises increasing the speed of rotation to a second higher speed.

* * * * *

UNITED STATES PATENT AND TRADEMARK OFFICE

CERTIFICATE OF CORRECTION

PATENT NO. : 4,888,213

DATED : December 19, 1989

INVENTOR(S) : WILLIAM G. HESTERBERG

It is certified that error appears in the above-identified patent and that said Letters Patent is hereby corrected as shown below:

COL. 5, LINE 29, claim 7, After "of" insert ---spaced holes, said hanger means comprises a pair of---

Signed and Sealed this

Thirtieth Day of July, 1991

*Attest:*

*Attesting Officer*

HARRY F. MANBECK, JR.

*Commissioner of Patents and Trademarks*